US005540241A

United States Patent [19]

Kim

[11] Patent Number: 5,540,241

[45] Date of Patent: Jul. 30, 1996

[54] CIGARETTE HOLDER WITH FILTER

[76] Inventor: Yong-sik Kim, 170-14, Sinjeong 7-dong, Yangcheon-ku, Seoul, Rep. of Korea

[21] Appl. No.: 219,668

[22] Filed: Mar. 29, 1994

[30] Foreign Application Priority Data

| | | | |
|---|---|---|---|
| Jul. 22, 1993 | [KR] | Rep. of Korea | 93-13713 |
| Aug. 20, 1993 | [KR] | Rep. of Korea | 93-16202 |
| Oct. 27, 1993 | [KR] | Rep. of Korea | 93-22222 |
| Nov. 30, 1993 | [KR] | Rep. of Korea | 93-25591 |
| Jan. 31, 1994 | [KR] | Rep. of Korea | 94-1770 |

[51] Int. Cl.[6] ..... A24F 13/10

[52] U.S. Cl. ..... 131/215.2; 131/215.1; 131/215.3; 131/173; 131/335

[58] Field of Search ..... 131/173, 335, 131/337, 215.1, 215.2, 215.3

[56] References Cited

U.S. PATENT DOCUMENTS

| | | | |
|---|---|---|---|
| 3,250,280 | 5/1966 | Hu | 131/215.2 |
| 3,318,315 | 5/1967 | Orter | 131/215.2 |
| 3,575,180 | 4/1971 | Carty | 131/173 |
| 3,805,808 | 4/1974 | Yoshinaga | 131/182 |
| 4,267,849 | 5/1981 | Smith | 131/84 |

*Primary Examiner*—V. Millin
*Assistant Examiner*—Charles W. Anderson
*Attorney, Agent, or Firm*—Christie, Parker & Hale, LLP

[57] ABSTRACT

A cigarette holder having a cigarette receiving member; a connecting member, which is connected to the receiving member, having a hygroscopic filter which may be a carbon bar with water; a mouthpiece member connected to the connecting member; a first valve means between said receiving member and the connecting member for preventing leakage of water from the hygroscopic filter; a second valve means between the connecting member and the mouthpiece member for preventing leakage of water from the hygroscopic filter.

10 Claims, 10 Drawing Sheets

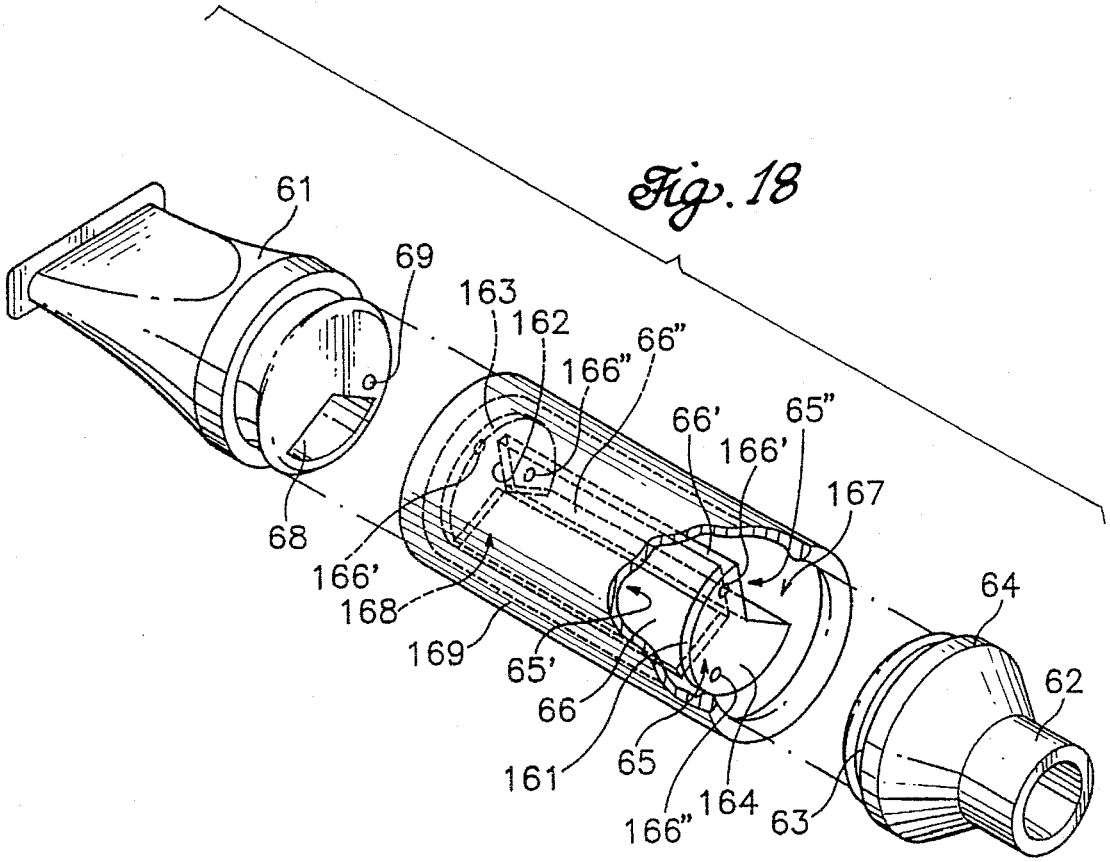
Fig. 18
Fig. 19
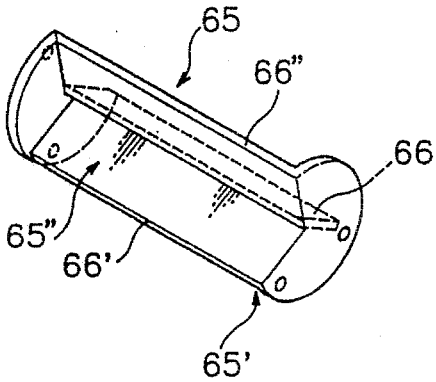
Fig. 20
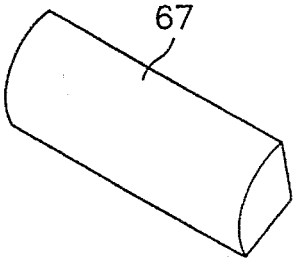

CIGARETTE HOLDER WITH FILTER

BACKGROUND OF THE INVENTION (1) Field of the Invention

The present invention relates to a cigarette holder and, more particularly, to a cigarette holder with a hygroscopic filter made of cotton material or carbon.

(2) Description of the Prior Art

Two important types of apparatus for smoking are a holder for a cigarette and a pipe for tobacco. The basic object of such an apparatus is to remove or to reduce nicotine or tars from tobacco smoke.

In recent years, the public has shown an increasing concern about the harmful effects of cigarette smoking. As a result, numerous cigarette filters have been designed in an attempt to provide an economical and efficient means to filter out ingredients present in tobacco smoke. Most of these devices, however, do not provide an economical and efficient solution to this problem.

It has long been known that nicotine and tars in tobacco smoke have an adverse effect on the health of smokers. More and more cigarettes are being sold with built-in, dry cigarette filters. But it has been found that hygroscopic filters are even more effective in removing tars and nicotine from tobacco smoke. This is a considerable health benefit to those who wish to continue smoking and assists those who wish to stop smoking their customary nicotine intake to levels which they could more easily do without.

As a result, numerous cigarette filters have been designed in an attempt to provide an economical and efficient means to filter out ingredients present in tobacco smoke. Most of these devices, however, do not provide an economical and efficient solution to this problem.

A conventional cigarette holder comprises a forward cigarette receiving member and a rearward mouthpiece member, the members constructed to form a central cavity adapted to receive a cylindrical filter cartridge.

However, the prior art cigarette holder containing a hygroscopic filtering agent generally suffers from the problem of leakage of the filtering agent. That is, the leakage of the filtering agent may cause the user's clothes to be soiled and cause the filtering agent to be dried. Therefore the holder can be used only for a short period and the filtering material should be changed or should be moistened again.

Some cigarette holders have been designed for exchange filtering material or filter cartridge. U.S. Pat. No. 4,267,849 provides a cigarette holder having a means for simple retrieving and replacing filtering material. However, the cigarette holder is too complicated to make.

Also the prior art cigarette holders are not sufficient for filtering nicotine or tars in tobacco smoke.

SUMMARY OF THE INVENTION

It is accordingly an object of the present invention to provide an improved cigarette holder containing a hygroscopic filtering material, wherein the apparatus is immune to leakage of the filtering agent, namely, water.

It is a further object of the invention to provide a new effective hygroscopic filter.

It is another object of the invention to provide an improved cigarette holder containing a hygroscopic filtering material, wherein the apparatus can be made more compact and effective in filtering toxic material than prior art cigarette holders.

It is still a further object of the invention to provide a cigarette holder with a shorter length.

In order to achieve the above objectives, the present invention provides a cigarette holder including a central cavity, one end of which is generally circularly shaped for receiving therein a cigarette or similar tobacco-filled product, and the opposite end of which is flattened for placement in the mouth of the smoker. Located in the central cavity of the holder is a cylindrical cartridge having a hygroscopic filter, having vented end walls. Valve means for preventing leakage of water from the hygroscopic filter are provided at both end walls of the hygroscopic filter. Each of the end walls contacts a dry filter.

The hygroscopic filter is preferably a carbon bar.

BRIEF DESCRIPTION OF THE DRAWINGS

These and other objects and advantages of the present invention will be more clearly understood from a consideration of the accompanying drawing in which:

FIG. 18 is a partial cutaway and exploded perspective view of a cigarette holder according to a fifth embodiment of the present invention;

FIG. 19 is a perspective view of the filter cartridge 169 of FIG. 18; and FIG. 20 is a filter which can be inserted into a space defined by the filter cartridge 169 of FIG. 18.

DETAILED DESCRIPTION OF THE PREFERRED EMBODIMENTS

Figure 1:
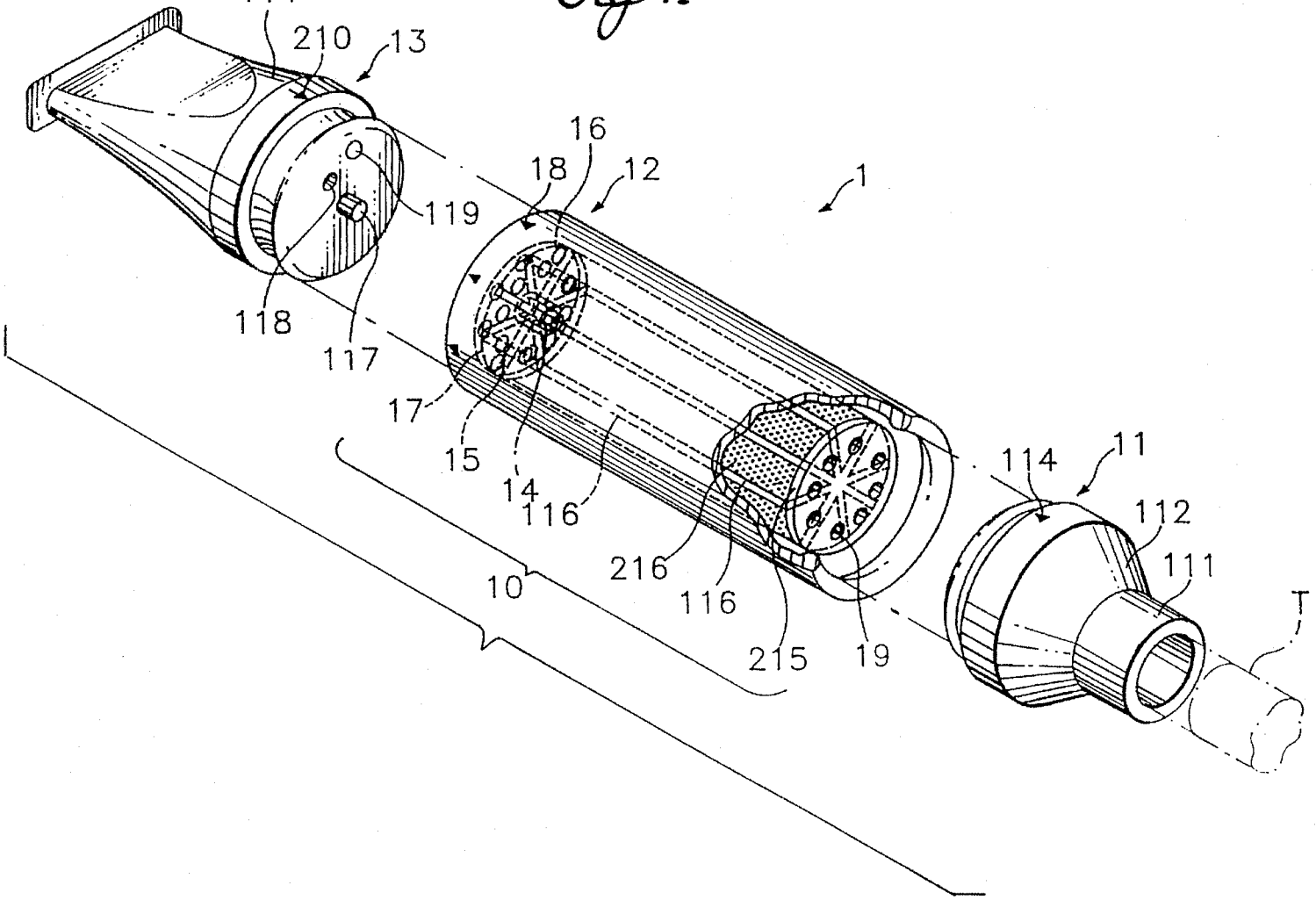
FIG. 1 is an exploded perspective view of a cigarette holder according to a first embodiment of the present invention.
Figure 2:
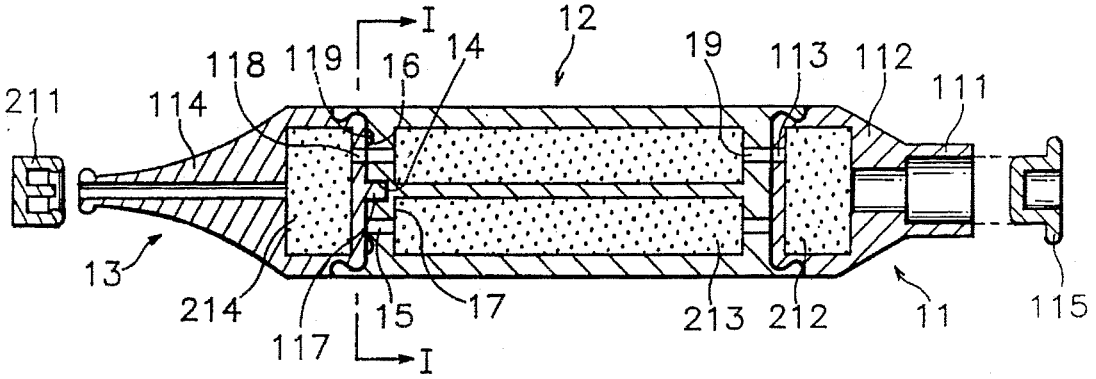
FIG. 2 is a longitudinal cross-sectional view of the cigarette holder according to the embodiment of FIG. 1.
Figure 3:
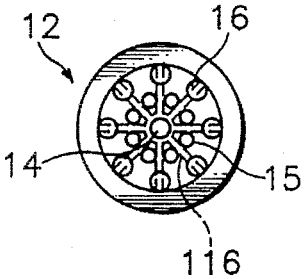
FIG. 3 is a cross-sectional view taken on line I—I of FIG. 1.

Referring to the drawings and particularly to FIGS. 1 through 3, a cigarette holder 1 according to a first embodiment of the present invention comprises a first pipe 11 having a dry filter 21, namely, a receiving member 11 for receiving therein a cigarette T, a second pipe 12 having a hygroscopic filter 213 and a third pipe. 13 having a dry filter 212, namely, a mouthpiece member. The first pipe 11 is friction fitted onto the second pipe 12, and the third pipe 13 is rotatably fitted to the second pipe 12. The hygroscopic filter 213 is cotton material, for example, a sponge with water and the dry filter 212 is a sponge. And as will be seen in FIG. 16 and FIG. 17, it can be a carbon bar with pores.

The first pipe 11 comprises a receiving portion 111, a body 112 having the dry filter 212, an aperture 113 for corresponding with one of apertures 19 of the second pipe 12 and a reference mark 114 on the outer circumference for aligning the aperture 113 of the first pipe 11 and one of the apertures 19 of the second pipe 12 and thereby forming first valve means. The receiving portion 111 receives a cigarette or a first stopper 115 for preventing a foreign substance from coming into the receiving portion 111 when not in use. And the mouthpiece 13 can be also covered with a second stopper 211.

The second pipe 12 has a cylindrical cartridge 10 having a plurality of partitions 116, two of which form a space 216 both ends of which have vented walls 17 and 215, equally angularly spaced from one another. The cartridge 10 is fixed to the second pipe 12. The wall 17 toward the third pipe 13 has a center hole 14 and both walls 17 and 215 have shallow holes 16 positioned at each partition 116. The hole 14 receives a protrusion 117 of the third pipe 13 and the shallow holes 16 which in turn receive a small protrusion 119 for mating one of apertures 15 of the wall 17 with an aperture 118 of the third pipe 13 and thereby forming second valve means. The small protrusion 119 and the shallow holes 16 play a role to keep one of the apertures 15 and the aperture 118 temporarily connected and, if the smoker wants to exchange the hygroscopic filter 213, the rotating force of the second member 12 by the smoker overcomes the connection of the small protrusion 119 and one of the shallow holes 16 and the small protrusion 119 is received into the next one of the shallow holes 16. The hygroscopic filter 213 is inserted into a space 216 made by the partitions 116. The second pipe 12 has reference marks 18 indicating positions of each partition 116 on its outer end circumference toward the third pipe 13.

The third pipe 13 has a dry filter 214. And the second pipe 12 can be formed of transparent material to determine the time it takes to exchange the hygroscopic filter and to rotate the second pipe 12 with respect to the mouthpiece 13.

In operation, smoke passes through the receiving portion 111, through the dry filter 212, through the aperture 113, through one of the apertures 19 of the wall 215 of the second pipe 12, through one piece of the hygroscopic filter 213, through one of the apertures 15, through the aperture 118, and through the dry filter 214 of the third pipe 13 to the user.

Figure 4:
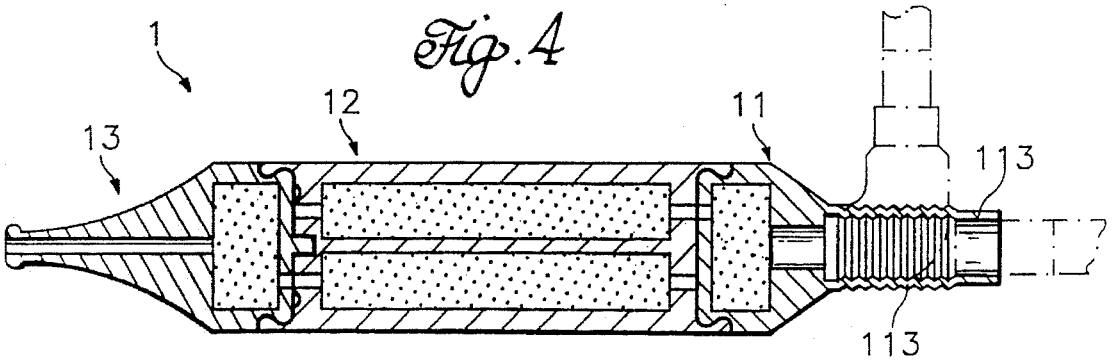
FIG. 4 is a longitudinal cross-sectional view of a cigarette holder according to an alternative embodiment of FIG. 1.

FIG. 4 shows a simple modification 1' of the first embodiment 1. With a cigarette T in the first pipe 11 of the first embodiment 1 the length of the holder is too long, so in this modification a bendable bellows 113 is inserted in the first pipe 11 and, for convenience, during inhalation by the smoker the whole length of the holder with a Cigarette can be shorter.

Figure 5:
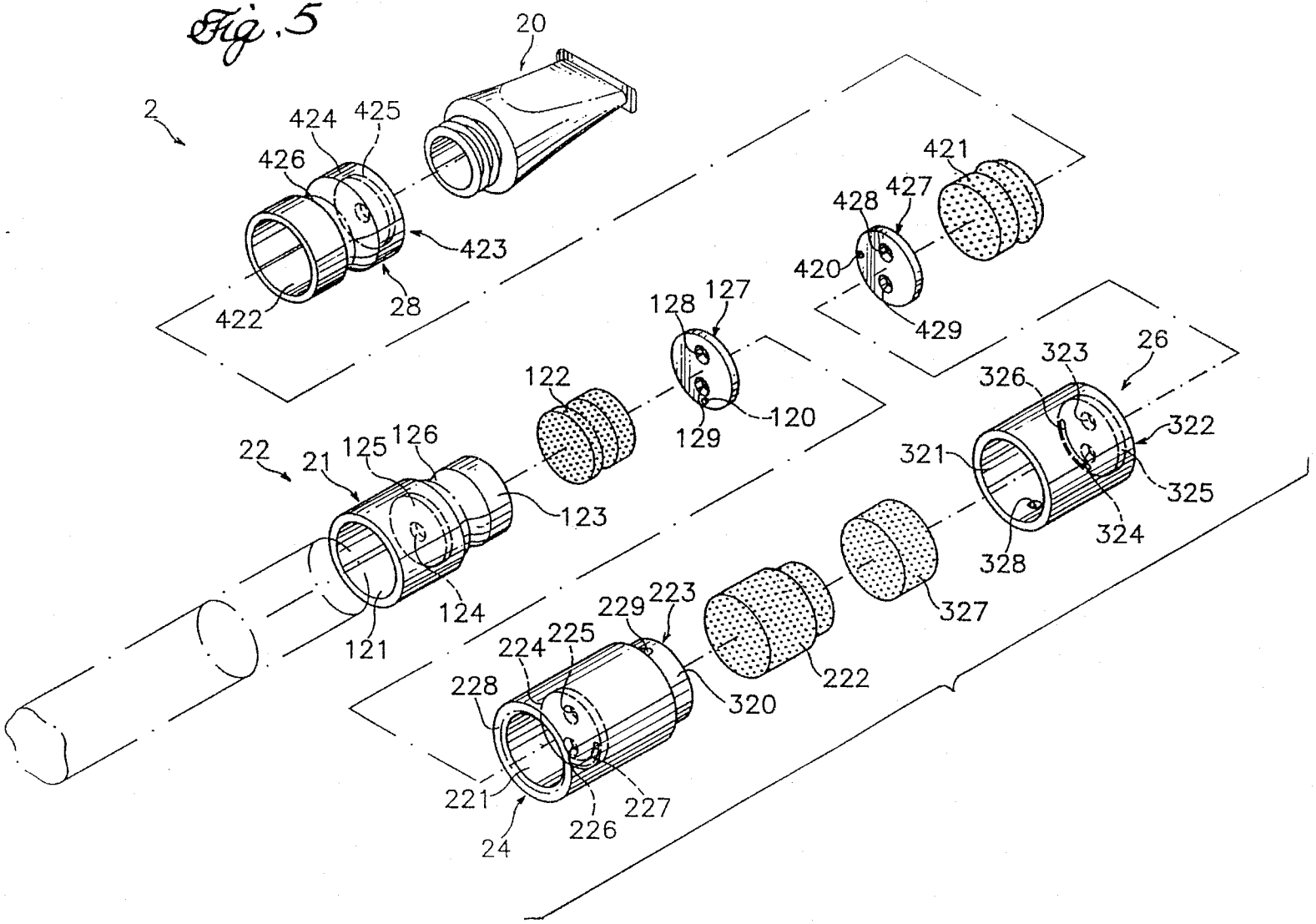
FIG. 5 is an exploded perspective view of a cigarette holder according to a second embodiment of the present invention.
Figure 6:
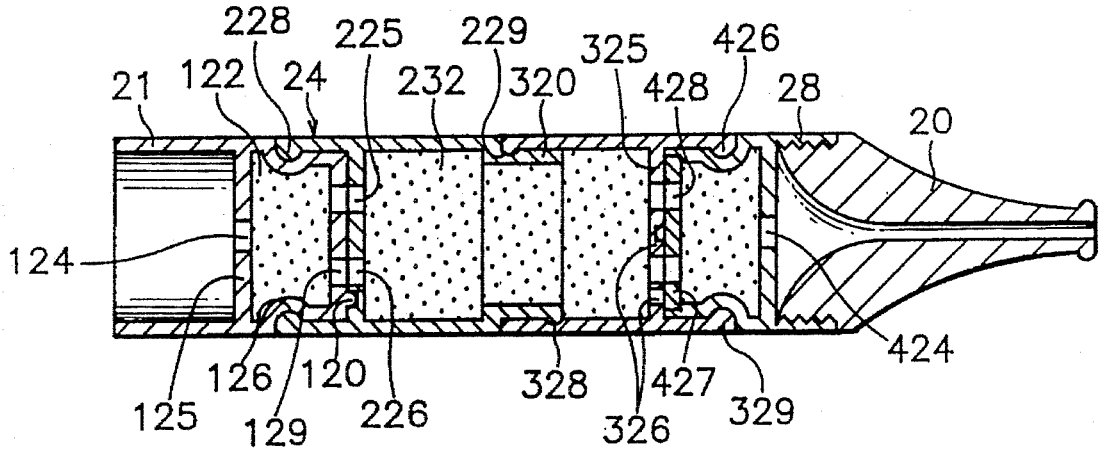
FIG. 6 is a longitudinal cross-sectional view of a cigarette holder according to the embodiment of FIG. 5.
Figure 7:
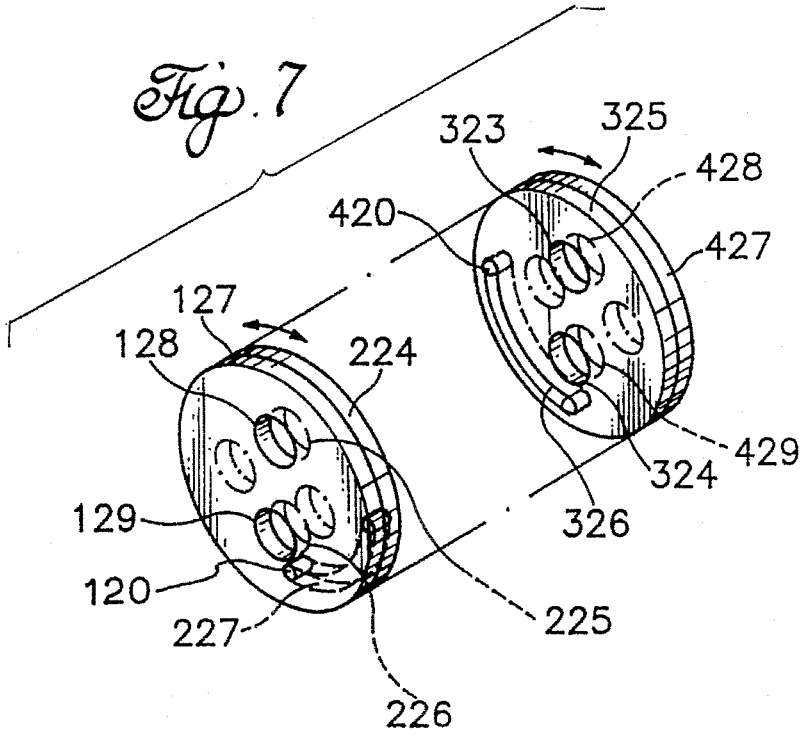
FIG. 7 is a schematic view showing operation of a connected portion of a cigarette holder according to the embodiment of FIG. 5.

Now referring to FIGS. 5 through 7, a cigarette holder 2 according to the second embodiment of the present invention Comprises a receiving pipe 22 for a cigarette T; a first connecting pipe 24, which rotatable with respect to the pipe 22 by a predetermined angle, fitted to the receiving pipe 22; a second connecting pipe 26 fitted to the first connecting pipe 24; a third connecting pipe 28, which is rotatable with respect to the pipe 26 by a predetermined angle, fitted to the second pipe 26; and a mouthpiece 20 having a threaded portion for being connected to the third pipe 28.

The receiving pipe 22 includes a first cavity 121 for receiving a cigarette T; a second cavity 123, which has a smaller outer diameter than the first cavity 121 and a circular groove 126 on its outer surface for connecting the first pipe 24, having a first rotating plate 127 which has two apertures 128 and 129 and a first protrusion 120 toward the first pipe 24 on its linear bottom, and having a first dry filter 122; and a first insolation plate 125 which separates the two cavities 121 and 123, having a first aperture 124.

The first connecting pipe 24 includes a third cavity 221 for connection with the receiving pipe 22 at an end, having an inward protrusion 228 corresponding to the groove 126 on its inner circumference; a fourth cavity 223 defining an inserting portion 320 with a small hole 229 for preventing any rotation with respect to the second connecting pipe 26, having a smaller outer diameter than the third cavity 221, and having a first hygroscopic filter 222 at the other end; and a second insolation plate 224, which separates the cavities 221 and 223, having two apertures 225 and 226 and a slot shaped as at 227 in FIG. 5.

The second connecting pipe 26 includes a fifth cavity 321, which has a small protrusion 328 corresponding to the small hole 229, corresponding to the inserting portion 320, having a second hygroscopic filter 327; a sixth cavity 322 having a circular protrusion 329 (see FIG. 6) at its end circumference for connection with the third connecting pipe 28; and a third insolation plate 325 separating the cavities 321 and 322, having two apertures 323 and 324 disposed vertically and a slot shaped as at 326 in FIG. 5.

The third connecting pipe 28 includes a seventh cavity 422, which is inserted in the sixth cavity 322, having a circular groove 426 for corresponding to the protrusion 329 in the outer circumference; a second rotating plate 427 for regulating the connection of the two pipes 26 and 28; a dry filter 421 in the seventh cavity 422; an eighth-cavity 423 having an inner nut; and a fourth insolation plate 425, which has a center aperture 424, separating the two cavities 422 and 423.

The second rotating plate 427 has two apertures 420 and 429 and a second protrusion 420 positioned as at 420 in FIG. 5 (a position of 9 o'clock of the plate 427) toward the second pipe 26.

The eighth cavity 423 is either screwed or friction fit onto the mouthpiece 20.

FIG. 7 illustrates operation of the second embodiment 2 of the present invention. a first and second valve means is provided to prevent leakage or evaporation of water in the hygroscopic filters 222 and 327 inside of the fourth and fifth cavity 223 and 321, respectively, the apertures 128 and 129 of the first rotating plate 127 are positioned as shown in dot-dashed lines in FIG. 7 which do not correspond to the apertures 225 and 226 of the second insolation plate 224. Also the apertures 323 and 324 of the third insolation plate 325 do not correspond to the apertures 428 and 429 of the second rotating plate 427 as shown in dot-dashed lines in FIG. 7.

If the receiving pipe 22 is rotated in a clockwise direction (viewed from the left direction of FIG. 7) with respect to the first and the second pipe 24 and 26 till the slot 227 prevents movement of the first protrusion 120, then the position of the apertures 128 and 129 coincide with the position of the apertures 225 and 226, respectively, so that smoke can pass through the apertures 128, 129, 225 and 226.

Operation of the second and the third pipe 26 and 28, especially the apertures 323, 324, 428 and 429 is the same as that of the receiving pipe 22 and the first pipe 24, as described above.

However, the direction of relative rotation of the pipes 26 and 28 is opposite to the direction of the relative rotation of the pipes 22 and 24.

Dry filters 122 and 421 are for perfect filtering and absorbing a litter water which can be from the hygroscopic filters 222 and 327.

Figure 8:
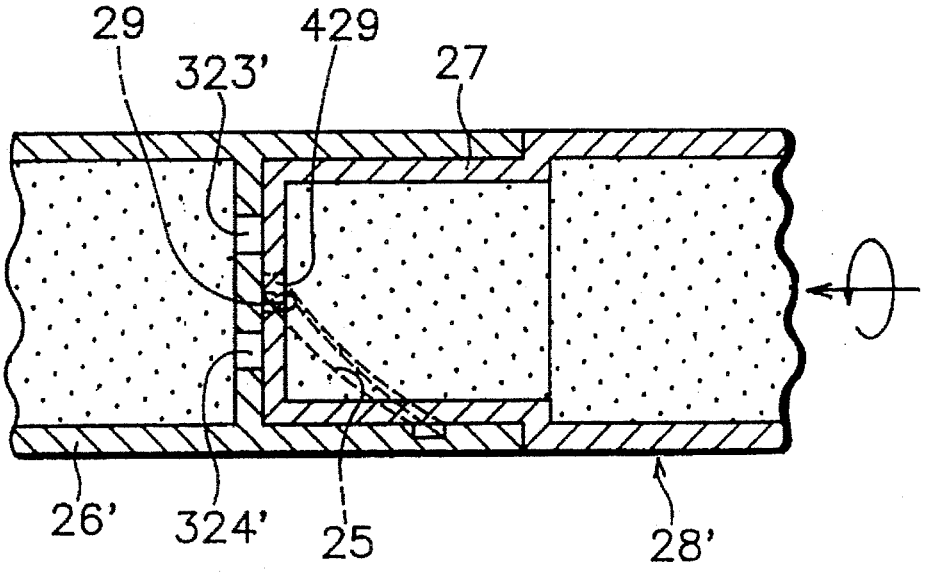
FIG. 8 is a fragmentary sectional view of a connected portion of a cigarette holder according to a simple modification of the embodiment of FIG. 5.
Figure 9:
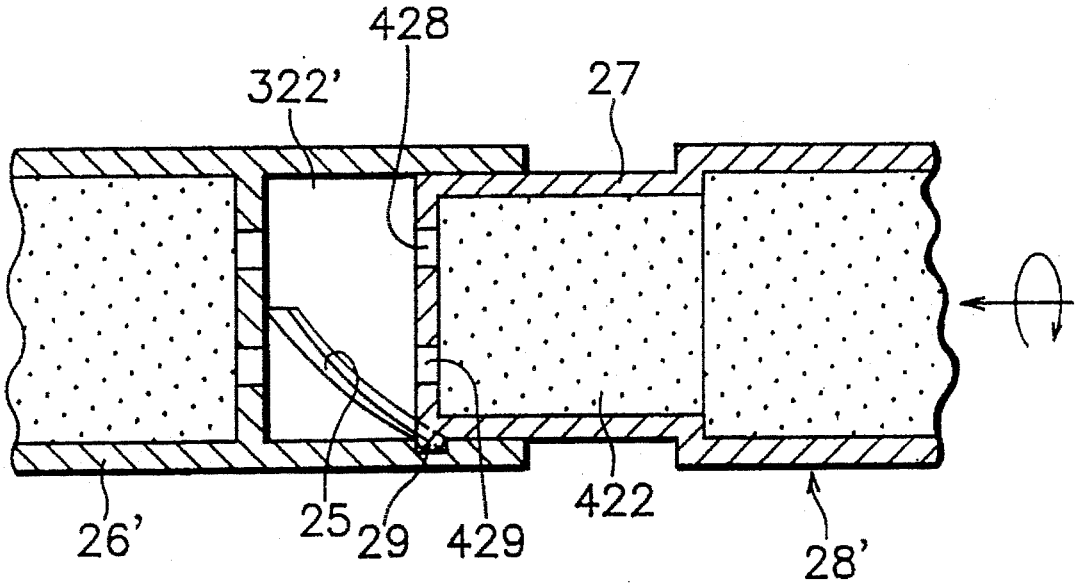
FIG. 9 is a similar view to FIG. 8 showing operation of the connected portion of FIG. 8.
Figure 10:
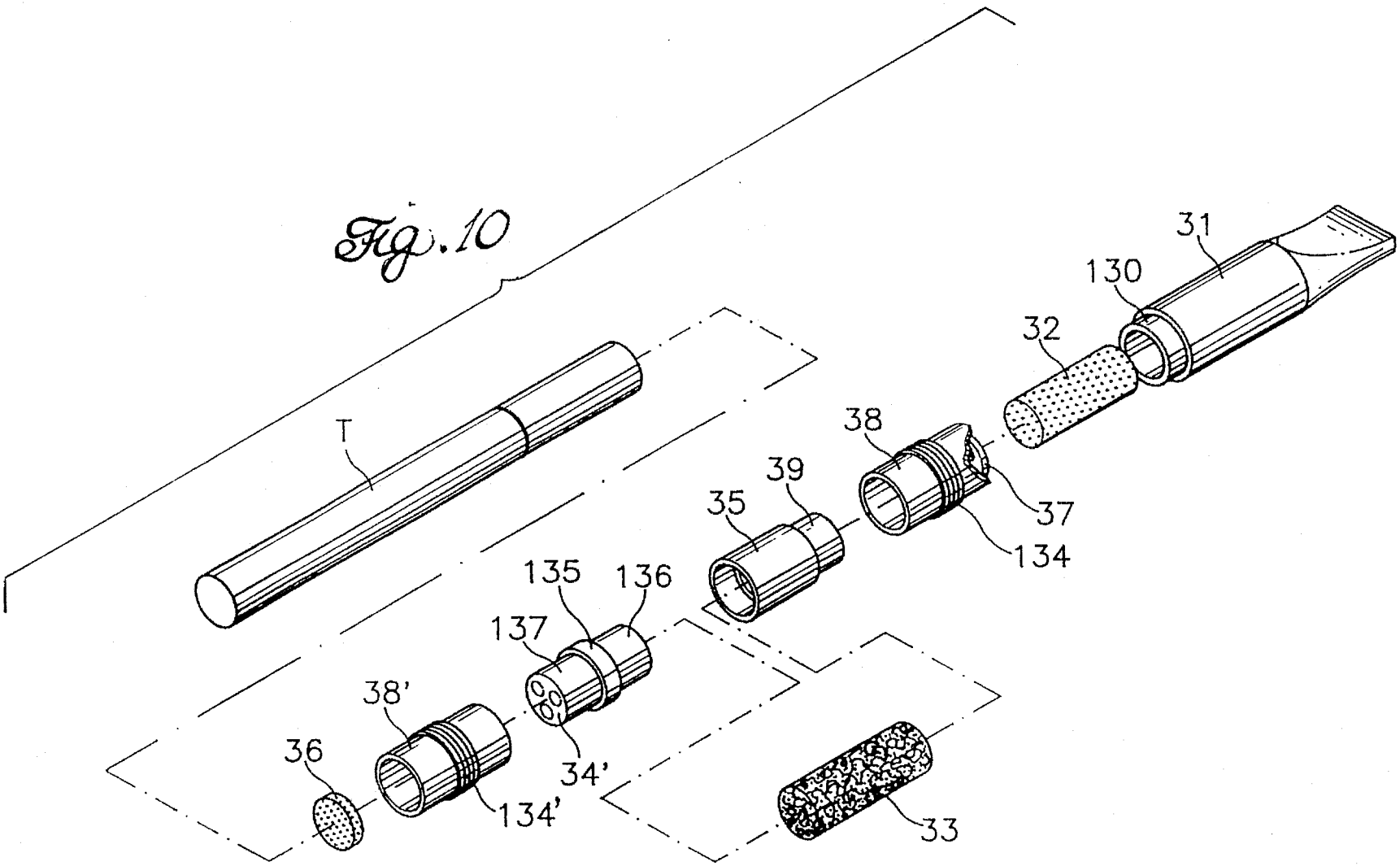
FIG. 10 is an exploded perspective view of a cigarette holder according to a third embodiment of the present invention.

Reference is now made to FIG. 8 and FIG. 9 showing a simple modification of the second embodiment according to the present invention. A sixth cavity 322' has a spiral groove 25 in its inner side for rotation of a third pipe 28' by 90 degrees with respect to the second pipe 26'.

The third pipe 28' has apertures 323 and 324, a protrusion 29 which can slide onto the groove 25 and the side surface 27, which define a seventh cavity 422.

The protrusion 29 and apertures 428 and 429 all of which lie linearly define the end portion of the seventh cavity 422.

If the third pipe 28' rotates fully toward the second pipe 26' and comes in contact with the second pipe 26' as in FIG. 8, the apertures 428' and 429' of the third pipe 28' do not coincide with the apertures 323' and 324' of the second pipe 26' so that the water of the hygroscopic filters 222 and 327 (see FIG. 5) will not leak out or evaporate and the smoke is prevented from passing through the apertures 323', 324', 428' and 429' when not in use. And if the third pipe 28 is withdrawn as in FIG. 9, the apertures 323' and 324' become separated from the apertures 428' and 429' so that the smoke can pass through the pipes 26' and 28'.

Reference is now made to FIG. 10, FIG. 11, FIG. 12A and FIG. 12B which illustrate a cigarette holder according to a third embodiment of the present invention. The cigarette holder comprises a mouthpiece 31 having a first dry filter 32, a first connecting pipe 38 having a first bellows 134 and a first perforating member 37, a second and a third connecting pipe 35 and 135 having a hygroscopic filter 33 commonly and a receiving pipe 38' having a second dry filter 36 and a second bellows 134' and a second perforating member 37' (see FIG. 12A).

The second and the third pipe 135 and 35 have a first and a second thin film 34 and 34', respectively, which prevent passage of smoke through the pipes 135 and 35 and prevent leakage or evaporation of water in the hygroscopic filter 33. The first and second thin films 34 and 34' in conjunction with the first and second perforating members 37 and 37' comprise the first and second valve means respectively.

The first and the second dry filters 36 and 32 are friction fitted in the mouthpiece 31 and the receiving pipe 38', and come in contact with the first and the second perforating members 37 and 37', respectively.

In order to assemble the cigarette holder there are portions 130, 39, 136 and 137 with a smaller diameter than the larger diameter of the pipes 31, 35, and 135, respectively.

Figure 11:
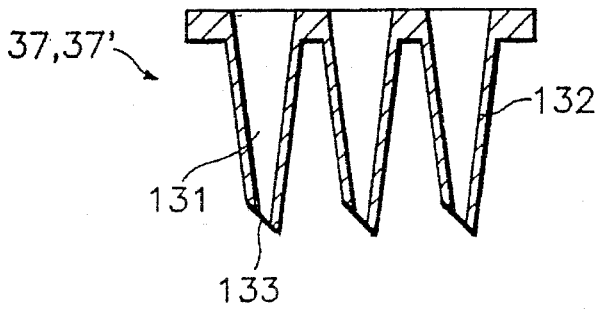
FIG. 11 is a sectional view showing a perforating member of the FIG. 10.

The perforating members 37 and 37' have a plurality of sharp protrusions 132 having an internal passage 131 as shown in FIG. 11. The upper portion of FIG. 11 contacts each dry filter 36 and 32. Inclined end portions 133 of the protrusions 132 help to poke holes in the thin films 34 and 34'.

When a cigarette T is pushed into the receiving pipe 38', the bellows 134 and 134' are compressed and the first and the second perforating member 37 and 37' poke the first and the second thin film 34 and 34', respectively. And when the cigarette T is released, the bellows 134 and 134' recover their initial lengths.

Figure 12A:
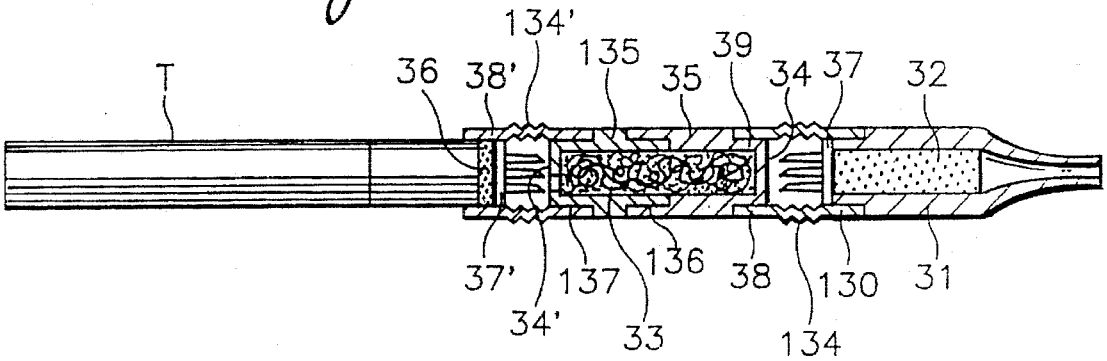
FIG. 12A and FIG. 12B are longitudinal cross-sectional views of a cigarette holder according to the embodiment of FIG. 10.

FIG. 12A shows the cigarette holder according to the third embodiment, where the cigarette T is not pushed yet or the cigarette T is released after the thin films are poked.

Figure 12B:
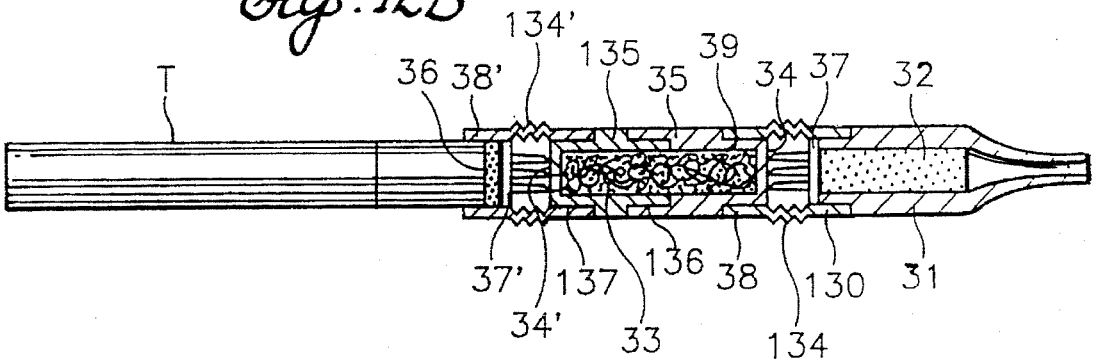
Figure 13:
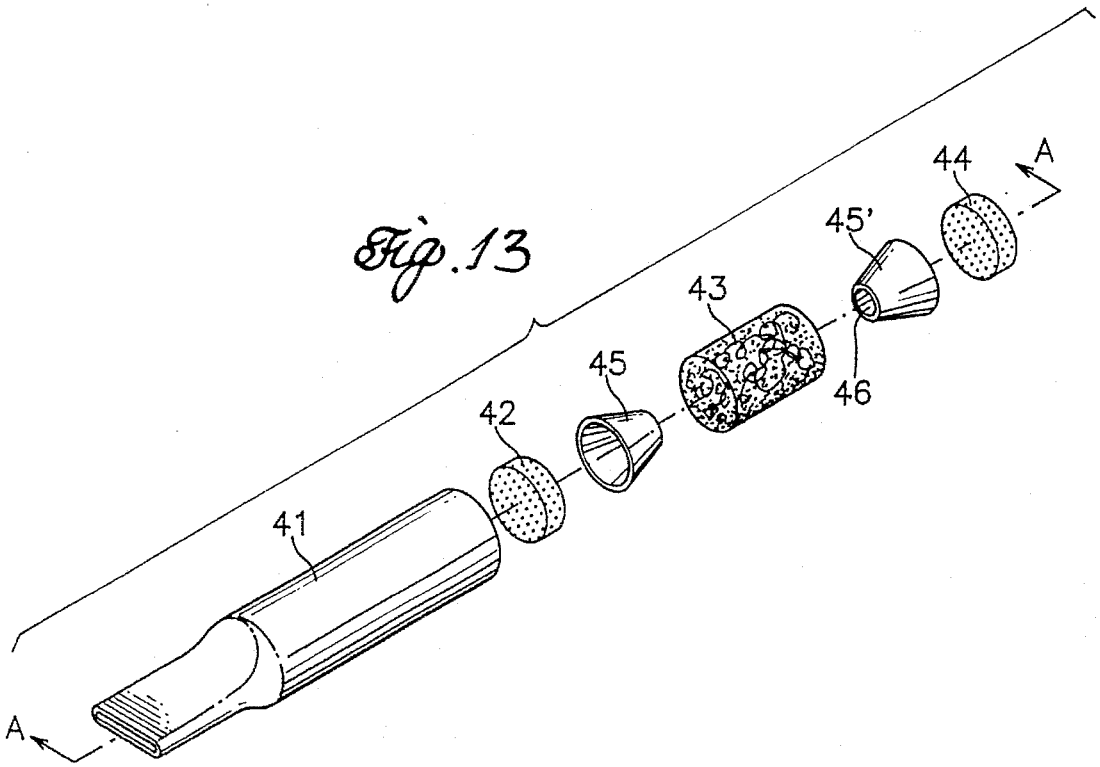
FIG. 13 is an exploded perspective view of a cigarette holder according to a fourth embodiment of the present invention.
Figure 14:
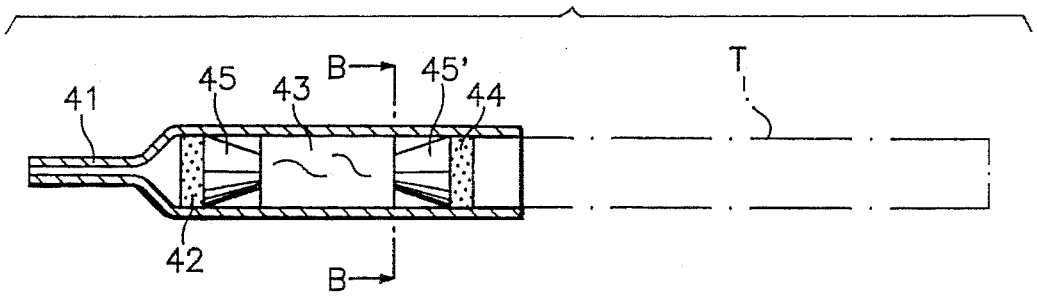
FIG. 14 is a cross-sectional view taken on line A—A of FIG. 13.
Figure 15:
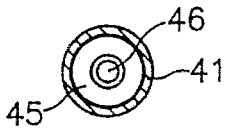
FIG. 15 is a cross-sectional view taken on line B—B of FIG. 14.

FIG. 12B shows a state while the cigarette T is being pushed into the holder.

Therefore, after the thin films are poked, smoke can pass the pipes 38', 135, 35' and 38 and the mouthpiece 31.

Reference is now made to FIGS. 13 through FIGS. 17 which illustrate a cigarette holder according to a fourth embodiment of the present invention.

A case 41 has a first dry filter 42, a first funnel 45, a hygroscopic filter 43, a second funnel 45', and a second dry filter 44 in regular sequence.

This embodiment is different from the preceding embodiments in having the funnels 45 and 45' act as the first and second valve means. The object of the funnels 45 and 45' is to prevent leakage of water from the hygroscopic filter 43. Since the funnels 45 and 45' have a center opening 46 and are friction fitted into the case 41 and, if the cigarette holder 41 lies horizontally, the water lies on the lower part of the case 41, the level of the water is lower than the center opening 46 and the water will not leak out through the funnels 45 and 45'.

If a litter water is transferred through the funnels 45 and 45', the dry filters 42 and 44 can absorb the water.

Figure 16:
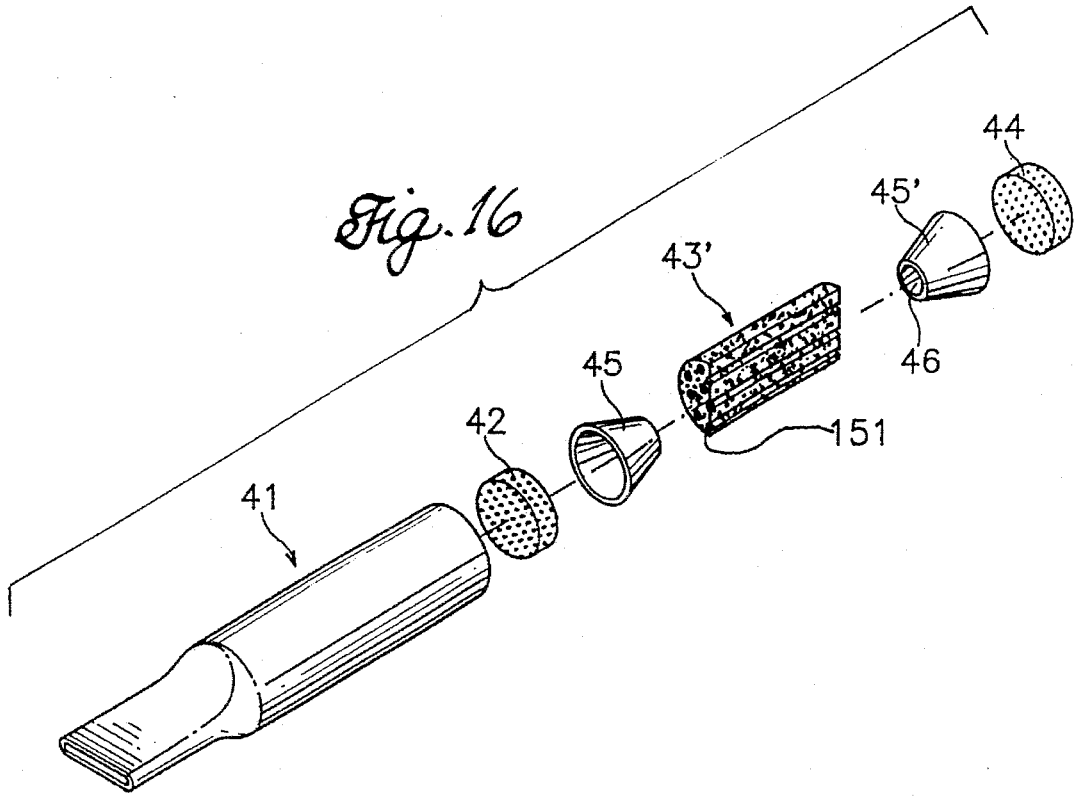
FIG. 16 is a partial cutaway and exploded perspective view of a cigarette holder according to a simple modification of the fourth embodiment of the present invention.

In FIG. 16 the hygroscopic filter 50 is carbon bar 59 wet with water, instead of other material such as cotton material. Carbon 59 has a good capacity in filtering tars and nicotine.

Figure 17:
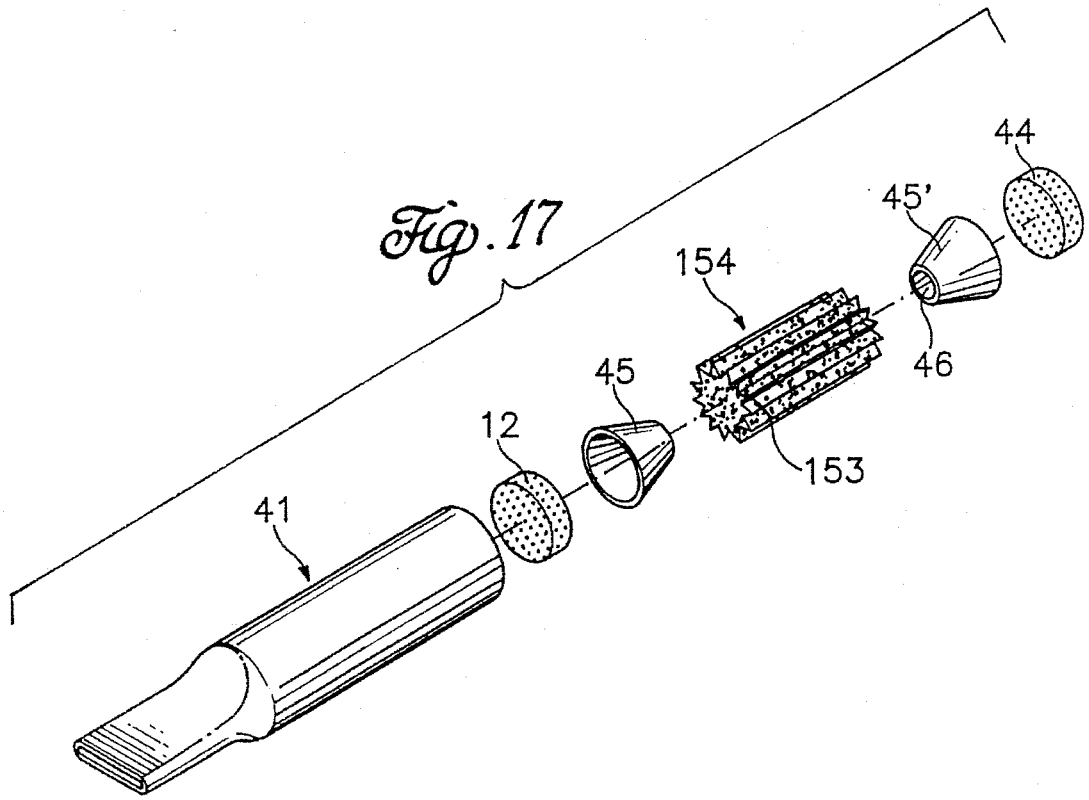
FIG. 17 is an exploded perspective view of another simple modification of the fourth embodiment of the, present invention.

In order to increase the surface area of the hygroscopic filter 43' there can be made a number of pores 151 as in FIG. 16 or the hygroscopic filter 51 can be formed as in FIG. 17.

In order to increase the surface area of the carbon bar, other shapes of the hygroscopic filter can be made with a number of protrusions as 153 of FIG. 17.

Reference is now made to FIGS. 18 through FIGS. 20 which show a cigarette holder according to a fifth embodiment of the present invention. FIG. 19 is a perspective view of the filter cartridge 169 of FIG. 18 and for better understanding it is rotated;

This cigarette holder is designed to shorten the length of the above and other prior art cigarette holders, but to lengthen passage of smoke.

The cigarette holder comprises a mouthpiece 61 having an opening 68 and a protrusion 69; a connecting pipe 169 or a filter cartridge having three spaces 65, 65', 65" defined by partitions 66, 66' 66"; and a receiving member 64 one end 63 which is formed the same as the mouthpiece 61, which has a protrusion and an opening (not shown), and the other end 62 which receives a cigarette.

The receiving pipe and the mouthpiece may have a dry filter for perfectly filtering nicotine and tars.

One space 65 has an opening 168 at one end wall 163 toward the mouthpiece 61 for communicating with the opening 68 of the mouthpiece 61 and a shallow hole 166 at the other outer wall 164, another space 65' has no opening but both outer walls 163 and 164 have a shallow hole 166', the other space 65" has an opening 167 at the other end wall 164 toward the receiving pipe 64 for communicating with an opening of the receiving pipe 64 (not shown) and a shallow hole 166" at the end outer wall 163 toward the mouthpiece 61.

The first partition 66 between the spaces 65 and 65' has a gap 161 from the wall 164 and the second partition 66' between the spaces 65' and 65" has a gap 162 tom the wall 163, but the third partition 66" between the spaces 65" and 65 has no gap between walls 163 and 164.

Each space 65, 65', 65" has a hygroscopic filter 67. Thus in FIG. 18 smoke can pass through the receiving pipe 64, through the opening 167, through the hygroscopic filter 67 in the space 65", through the gap 162, through the hygroscopic filter 67 in the space 65', through the gap 161, through the hygroscopic filter 67 in the space 65, through the opening 168 at the wall 163, and through the opening 68 of the mouthpiece 61 to the user.

In order to prevent leakage or evaporation of water from the hygroscopic filter 67, during inhalation the mouthpiece 61 is rotated with respect to the connecting pipe 169 and the connecting pipe 169 is rotated with respect to the receiving pipe 64 so that the openings 68 and 168 are not met and the opening 167 also does not communicate with the opening of the receiving pipe 64.

It is understood that the foregoing disclosure is given by way of illustrative example only, rather than by way of limitation, and that without departing from the invention, the details may be varied within the scope of the appended claims.

What is claimed is:

1. A cigarette holder comprising:

a cigarette receiving member;

a connecting member connected to said receiving member, said connecting member having a hygroscopic filter;

a mouthpiece member connected to said connecting member;

first valve means comprising a first and a second plate disposed between said receiving member and said connecting member and rotatably engageable for preventing leakage of water from the hygroscopic filter, said first plate having two holes and an arc shaped slot, and said second plate having two holes and a protrusion corresponding to the slot; and second valve means for preventing leakage of water from the hygroscopic filter, said second valve means being disposed between said connecting member and said mouthpiece member.

2. A cigarette holder comprising:

a cigarette receiving member;

a connecting member connected to said receiving member, said connecting member having a hygroscopic filter;

a mouthpiece member connected to said connecting member;

first valve means for preventing leakage of water from the hygroscopic filter, said first valve means being disposed between said receiving member and said connecting member; and second valve means comprising a first and a second plate disposed between said connecting member and said mouthpiece member and rotatably engageable for preventing leakage of water from the hygroscopic filter, said first plate having two holes and an arc shaped slot, and said second plate having two holes and a protrusion corresponding to the slot.

3. A cigarette holder comprising:

a cigarette receiving member;

a connecting member connected to said receiving member, said connecting member having a hygroscopic filter;

a mouthpiece member connected to said connecting member;

first valve means comprising a first funnel, the first funnel being disposed between said receiving member and said connecting member and friction fitted onto said connecting member for preventing leakage of water from the hygroscopic filter; and second valve means comprising a second funnel, the second funnel being disposed between said connecting member and said mouthpiece member and friction fitted onto said connecting member for preventing leakage of water from the hygroscopic filter.

4. A cigarette holder comprising:

a cigarette receiving member;

a connecting member connected to said receiving member, said connecting member having a hygroscopic filter;

a mouthpiece member connected to said connecting member;

first valve means for preventing leakage of water from the hygroscopic filter, said first valve means being disposed between said receiving member and said connecting member;

second valve means for preventing leakage of water from the hygroscopic filter, said second valve means being disposed between said connecting member and said mouthpiece member; and wherein the first and second valve means each comprises a bellows, a thin film adjacent to said hygroscopic filter, and perforating means disposed in said bellows for puncturing the thin film before using the cigarette holder.

5. A cigarette holder comprising:

a cigarette receiving member;

a connecting member connected to said receiving member, said connecting member having a plurality of spaces each of which have a hygroscopic filter, the spaces being defined by a plurality of partitions of the connecting member;

means for rotating the connecting member by a predetermined angle with respect to the receiving member so that a user can inhale smoke through a new hygroscopic filter within a neighboring space of the connecting member;

a mouthpiece member connected to said connecting member;

first valve means for preventing leakage of water from the hygroscopic filter, said first valve means being disposed between said receiving member and said connecting member; and second valve means for preventing leakage of water from the hygroscopic filter, said second valve means being disposed between said connecting member and said mouthpiece member.

6. A cigarette holder comprising:

a cigarette receiving member having a bendable bellows for substantially shortening a length of the cigarette holder;

a connecting member connected to said receiving member, said connecting member having a hygroscopic filter;

a mouthpiece member connected to said connecting member;

first valve means for preventing leakage of water from the hygroscopic filter, said first valve means being disposed between said receiving member and said connecting member; and second valve means for preventing leakage of water from the hygroscopic filter, said second valve means being disposed between said connecting member and said mouthpiece member.

7. A cigarette holder comprising:

a cigarette receiving member;

a connecting member connected to said receiving member, said connecting member having a plurality of spaces each of which have a hygroscopic filter, the spaces are defined by a plurality of partitions, the partitions and the spaces being designed to make a passage of smoke substantially longer than the connecting member;

a mouthpiece member connected to said connecting member;

first valve means for preventing leakage of water from the hygroscopic filter, said first valve means being disposed between said receiving means and said connecting member; and second valve means for preventing leakage of water from the hygroscopic filter, said second valve means being disposed between said connecting member and said mouthpiece member.

8. A cigarette holder according to claim 5 wherein the receiving member and the mouthpiece each have a dry filter.

9. A cigarette holder according to claim 5 wherein the hygroscopic filters comprise a wet carbon bar.

10. A cigarette holder according to claim 9 wherein each carbon bar has a plurality of pores.

* * * * *

UNITED STATES PATENT AND TRADEMARK OFFICE

CERTIFICATE OF CORRECTION

PATENT NO. : 5,540,241
DATED : July 30, 1996
INVENTOR(S) : Yong-sik Kim

It is certified that error appears in the above-indentified patent and that said Letters Patent is hereby corrected as shown below:

Column 2, line 21, change "drawing" to -- drawings --.
Column 2, line 28, change "FIG. 1" to -- FIG. 2 --.
Column 2, line 66, after "the" delete the comma.
Column 3, line 18, after "pipe" delete the period.
Column 3, line 62, after "filter" insert -- 213 --.
Column 4, line 8, change "Cigarette" to -- cigarette --.
Column 4, line 12, change "Comprises" to -- comprises --.
Column 4, line 13, after "which" insert -- is --.
Column 4, line 66, change "a first" to -- A first --.
Column 6, line 25, before "the pipes" insert -- through --.
Column 6, line 59, change "rotated;" to -- rotated. --.
Column 7, line 17, after "162" replace "tom" with -- from --.

Signed and Sealed this

Twenty-eighth Day of October, 1997

*Attest:*

Bruce Lehman

BRUCE LEHMAN

*Attesting Officer*

*Commissioner of Patents and Trademarks*